United States Patent [19]

Niitsuma et al.

[11] Patent Number: 4,924,950

[45] Date of Patent: May 15, 1990

[54] METHOD OF DRILLING A WELL BY UTILIZING AE/MA MEASUREMENT

[75] Inventors: Hiroaki Niitsuma; Katsuto Nakatsuka; Hiroyuki Abe, all of Sendai; Morihiko Takanohashi; Ko Sato, both of Morioka; Fumihiko Chiba, Iwate, all of Japan

[73] Assignees: K. Nakatsuka; H. Abe; Japan Metals & Chemicals Co., Ltd.; H. Niitsuma, Japan

[21] Appl. No.: 291,357

[22] Filed: Dec. 29, 1988

Related U.S. Application Data

[63] Continuation of Ser. No. 917,956, Oct. 14, 1986, abandoned.

[30] Foreign Application Priority Data

Oct. 16, 1985 [JP] Japan ..... 60-230391

[51] Int. Cl.[5] ..... E21B 49/00

[52] U.S. Cl. ..... 175/50; 166/250; 173/151

[58] Field of Search ..... 175/40, 41, 50; 166/250; 73/151

[56] References Cited

U.S. PATENT DOCUMENTS

| | | | |
|---|---|---|---|
| 3,739,871 | 6/1973 | Bailey . | |
| 3,865,201 | 2/1975 | Haden | 166/250 X |
| 4,057,780 | 11/1977 | Shuck . | |
| 4,273,212 | 6/1981 | Dorr et al. | 175/40 X |
| 4,280,200 | 7/1981 | Silverman . | |
| 4,432,078 | 2/1984 | Silverman . | |
| 4,524,434 | 5/1985 | Silverman . | |

OTHER PUBLICATIONS

James N. Albright et al., "Acoustic Emissions as a Tool for Hydraulic Fracture Location": Experience at the Fenton Hill Hot Dry Rock Site, *Society of Petroleum Engineers Journal,* Aug. 1982, pp. 523–530.

Hiroaki Niitsuma et al., "AE Measurement and Signal Processing in Elastic-Plastic Fracture Toughness Test", *Journal of N.D.I.,* vol. 30, No. 11, Nov. 1981, pp. 886–889.

Katsuto Nakatsuka et al., "In-Situ Measurement of the Extension of Hydraulically-Formed Fracture in Geothermal Well by Means of Acoustic Emission", *Journal of Mining and Metalluragical Institute of Japan,* vol. 98, No. 1129, Mar. 1982.

Hideaki Takahashi et al., "Determination of Fracture Toughness of Granitic Rock by Means of AE Technique", *Journal of Mining and Metalluragical Institute of Japan,* vol. 100, No. 1151, Jan. 1984.

Morihiko Takanohashi et al., "Evaluation of Rock Fracture Toughness in the Presence of Water Pressurized at Elevated Temperature by Means of AE Technique", *Proceedings of the 6th Japan Symposium on Rock Mechanics,* pp. 391–396, Dec. 1984, (corresponds to Progress in Acoustic Emission II, noted below).

Morihiko Takanohashi et al., "Evaluation of Rock Fracture Toughness in the Presence of Pressurized Water at Elevated Temperature by Means of AE Technique", *Progress in Acoustic Emission II,* pp. 624–631, Oct. 1984.

Niitsuma, Hiroaki et al., "Downhole AE Measurement of a Geothermal Reservoir and its Application to Reservoir Control", Oct. 1985, pp. 1–15.

(List continued on next page.)

*Primary Examiner*—William P. Neuder

*Attorney, Agent, or Firm*—Oliff & Berridge

[57] ABSTRACT

A method of drilling a well by utilizing AE/MA measurement which has the steps of monitoring an AE wave emitted at the periphery of the well, and drilling the well without lost circulation by providing lost circulation preventing means in the well if the energy of the AE wave emitted at the periphery of the well increases. Thus, the method can confirm a lost circulation layer, i.e., the size, the place and the direction of the underground crack to further determine whether further drilling is necessary or not.

5 Claims, 6 Drawing Sheets

OTHER PUBLICATIONS

Hiroyuki Abe et al., "Behaviors of Crack-Like Reservoirs by Means of Fracturing at Nigorikawa and Kakkonda Geothermal Fields", Proceedings Ninth Workshop Geothermal Reservoir Engineering, pp. 403-408, Dec. 1983.

Hiroaki Niitsuma et al., "New Evaluation Method of Geothermal Reservoir by Field AE Measurement", Progress in Acoustic Emission II, pp. 642-651, Oct. 1984.

H. Niitsuma et al., "Acoustic Emission Measurement of Geothermal Reservoir Cracks in Takinoue (Kakkonda) Field, Japan", *Geothermics*, vol. 14, No. 4, pp. 525-538, 1985.

H. Niitsuma et al., "Long-Distance Acoustic Emission Monitoring of Hydraulically Induced Subsurface Cracks in Nigorikawa Geothermal Field, Japan", Geothermics, vol. 14, No. 4, pp. 539-551, 1985.

METHOD OF DRILLING A WELL BY UTILIZING AE/MA MEASUREMENT

This is a continuation of application Ser. No. 917,956, filed Oct. 14, 1986, now abandoned.

BACKGROUND OF THE INVENTION

The present invention relates to a method of drilling a well such as a geothermal well and, more particularly, to a process for drilling a well by utilizing AE/MA method (Acoustic Emission/Microseismic Activity).

When a geothermal well, a petroleum well, a natural gas well or a spring well is drilled by known methods, a bit is rotated to drill the well. In this case, drilling fluid is used to constantly remove drilling chips from the bottom of the borehole or the vicinity of the pit, to convey the chips to the ground to clean the borehole, to cool the bit, a drill collar and drill strings, to smoothly rotate the bit and to form a thin and tough impermeable membrane on the wall of the borehole.

As shown in FIG. 1, in the case of generally drilling a well with drilling fluid, a bit 1 of the end of a drilling conduit 2 is rotated by a rotary machine 3 through the conduit 2 and the collar 4, and drilling fluid (mud) 5 is supplied through the conduit to the end of the bit 1, discharged externally from the end of the bit, and recovered on the ground through the outside of the conduit. The drilling chips in the drilling fluid are separated and removed from the recovered drilling fluid, additives for drilling fluids are then suitably added, and the drilling fluid is recirculated for use.

However, when drilling the well with drilling fluid, the used drilling fluid is frequently lost while drilling, and so-called lost circulation frequently occurs.

Causes of lost circulation generally are known to include an encounter with rough particularly permeable formations or previous cracks, hydrostatic pressure of the drilling fluid and/or surge pressure produced by the pumping pressure for circulation or drilling conduit as artificial pressure.

If such lost circulation occurs while drilling in this manner, it is a disadvantage that drilling fluid of a larger quantity than otherwise required must be supplied resulting in huge expenses for drilling.

Heretofore, known methods of detecting if lost circulation occurs while drilling include a method of detecting the position of the lost circulation by moving a thermometer down into a well to measure the temperatures of the drilling fluid and the formation, and detecting the position of the lost circulation from the temperature change, and a method of detecting the position of the lost circulation by moving a small-sized spinner unit down into a well and detecting the position from the rotating speed difference of the spinner.

The conventional methods of detecting the position of the lost circulation during drilling the well can be carried out only after the lost circulation occurs, and it has such a disadvantage that a considerable amount of drilling fluid is still lost in fact.

SUMMARY OF THE INVENTION

The inventors of the present invention have developed a method of predicting lost circulation during drilling of a well before the lost circulation occurs by utilizing AE/MA measurement during drilling of a well.

Further, the inventors have also analyzed AE waves in the case of drilling a well by utilizing AE/MA measurement, and have confirmed a lost circulation layer, i.e., the size, the place and the direction of an underground crack, to further determine whether further drilling is warranted or not.

Accordingly, an object of the present invention is to provide a method of drilling a well by utilizing AE/MA measurement which can predict lost circulation during drilling a well before the lost circulation occurs.

Another object of the present invention is to provide a method of drilling a well by utilizing AE/MA measurement which can confirm a lost circulation layer, i.e., the size, the place and the direction of an underground crack, to further determine whether further drilling is warranted or not.

According to one aspect of the present invention, there is provided a method of drilling a well by utilizing AE/MA measurement comprising the steps of monitoring an AE wave emitted at the periphery of the well, and drilling the well without lost circulation by providing lost circulation preventing means in the well if the energy of the AE wave emitted at the periphery of the well increases.

According to another aspect of the present invention, there is provided a method of drilling a well such as a geothermal well, a petroleum well, or a natural gas well, by utilizing AE/MA measurement comprising the steps of monitoring an AE wave emitted at the periphery of a lost circulation position if lost circulation occurs during drilling of the well to obtain the size and extending direction of the lost circulation layer, and drilling the well while determining whether drilling of the well should be continued or stopped in accordance with the information.

DESCRIPTION OF THE PREFERRED EMBODIMENTS

Figure 1:
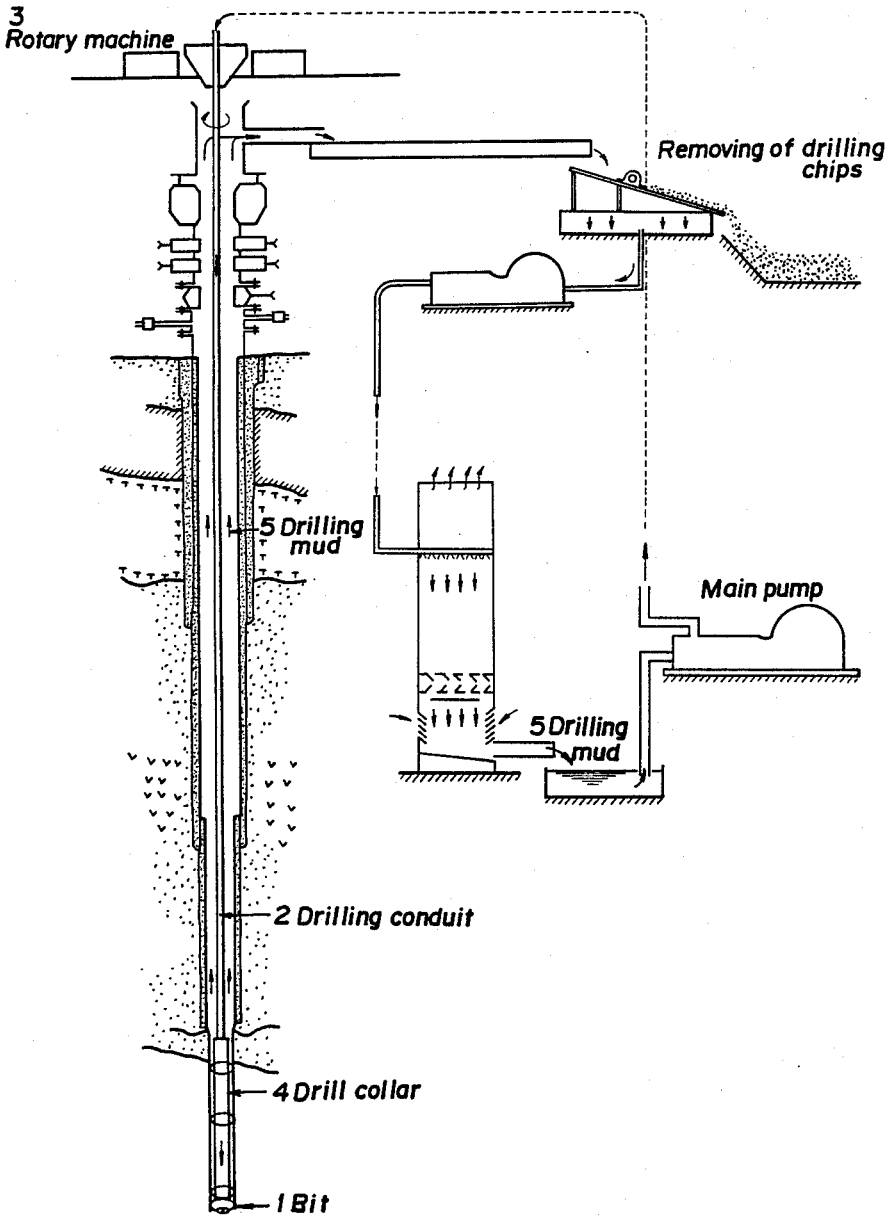
FIG. 1 is a schematic view of a drilling job with circulating drilling fluid.

The AE measurement technique further described below detects an acoustic emission (AE) wave in an audio frequency band immediately before materials are deformed or fractured.

The AE measurement technique has been used for nondestructive inspection in the field of metallic material, a plant structure or pressure vessels, and AE recently have been measured upon fracture of rocks, and there is proposed a method of presuming a macrocrack occurrence starting point from the abruptly increasing point of the AE energy in laboratory experiment (disclosed in Journal Mining and Metallurgical Institute of Japan, Vol. 100, No. 1151 issued in January, 1981).

As an example of AE measurement in the field, there was a report of a relationship between the rise of pressure in hydraulic fracturing of geothermal wells and the emission of AE utilized for a geothermal power plant (disclosed in Journal of Mining and Metallurgical Institute of Japan, Vol. 98, No. 1129 issued in March, 1982).

Various reports have been issued in addition to the abovementioned reports as to the detection of AE in the subsurface. In summary, detection is made by installing an AE sonde in the subsurface, amplifying the AE detected by the AE sonde by a main amplifier, recording the waveform of the AE in a data recorder, further A/D (analog/digital) converting the waveform to input it into a computer, and determining a distance from the AE sonde and an AE source by a time differnce between P-wave and S-wave in the computer. The AE sonde includes a tri-axial AE sonde and a mono-axial AE sonde, and the tri-axial AE sonde is preferable from the view of detecting with a single observation well. The AE energy can be calculated from the amplitude of the detected AE waveform or a ringdown count.

On the other hand, if upon encountering an underground crack, or an artificial pressure such as a surge pressure produced by hydrostatic pressure by drilling fluid or a pumping pressure for circulation and moving down a conduit along the wall of the borehole when drilling the well with the drilling fluid as described above, a crack takes place in the wall of the borehole, the crack gradually extending during drilling, lost circulation will finally occur.

The inventors of the instant invention can confirm the emission of AE immediately before lost circulation by measuring the AE during drilling of a well. More specifically, they have devised a novel method of searching in advance where lost circulation may occur by monitoring the AE from the lost circulation area immediately before the cracking which causes lost circulation.

Heretofore, lost circulation during drilling could be monitored only after the lost circulation actually occurred. However, the present invention can rapidly and accurately monitor in advance the position of a lost circulation by utilizing AE measurement, and can accordingly prevent a huge loss of drilling fluid caused by lost circulation and largely reduce the time to be wasted for remedying the lost circulation.

As described above, after the position of the lost circulation is determined, a countermeasure for the lost circulation may be carried out immediately in response thereto. For example, the pumping pressure of the drilling fluid is immediately reduced temporarily to an allowable range or pumping of drilling fluid is momentarily stopped altogether, or a lost circulation prevention material such as rubber or fibrous material is supplied together with the drilling fluid to prevent the lost circulation by repairing the damaged wall of the well. In this case, it is also effective to suitably reduce the specific weight of the drilling fluid used. When the lost circulation is prevented in this manner and the well is subsequently drilled, the drilling can be continued without any lost circulation.

On the other hand, whether the drilling well has encountered underground cracks (a lost circulation layer) near the target depth is determined by the existence of a lost circulation. Also in this case, before arriving at underground cracks (a lost circulation layer), that is immediately before a lost circulation occurs, it is recognized that AE starts emitting in the same manner as described above and an accumulated ringdown count is abruptly increased at the lost circulation layer. Further, the lost circulation layer (underground crack) can be confirmed by a geological survey or geophysical prospecting, but the present invention can search directly for the lost circulation layer. When encountering or arriving at the lost circulation layer while drilling a well, the geometrical shape of the lost circulation layer can be simply grasped by identifying the position of the AE layer.

As described above, the present invention can judge whether the underground crack can be utilized for a reservoir of natural gas or geothermal steam by grasping the shape of the lost circulation layer and hence the underground crack, and further confirming the presence or absence of the relationship to the so-called reinjected zone in the case of reinjecting in the underground crack such as a geothermal well. Therefore, the present invention can provide a basis for determining whether the drilling of the well should be further continued or not.

The present invention applies not only to drilling of wells, but also to various boreholes such as petroleum wells, natural gas wells or spring wells. As described above, the present invention can prevent in advance the lost circulation by utilizing the AE measurement in the case of drilling a well, and suitably grasps the geometrical shape of the lost circulation layer produced with a lost circulation to provide a basis for determining whether the well should be further drilled or not.

The present invention will now be described in more detail with reference to the accompanying drawings by way of preferred examples.

EXPERIMENTAL EXAMPLE 1

Figure 2:
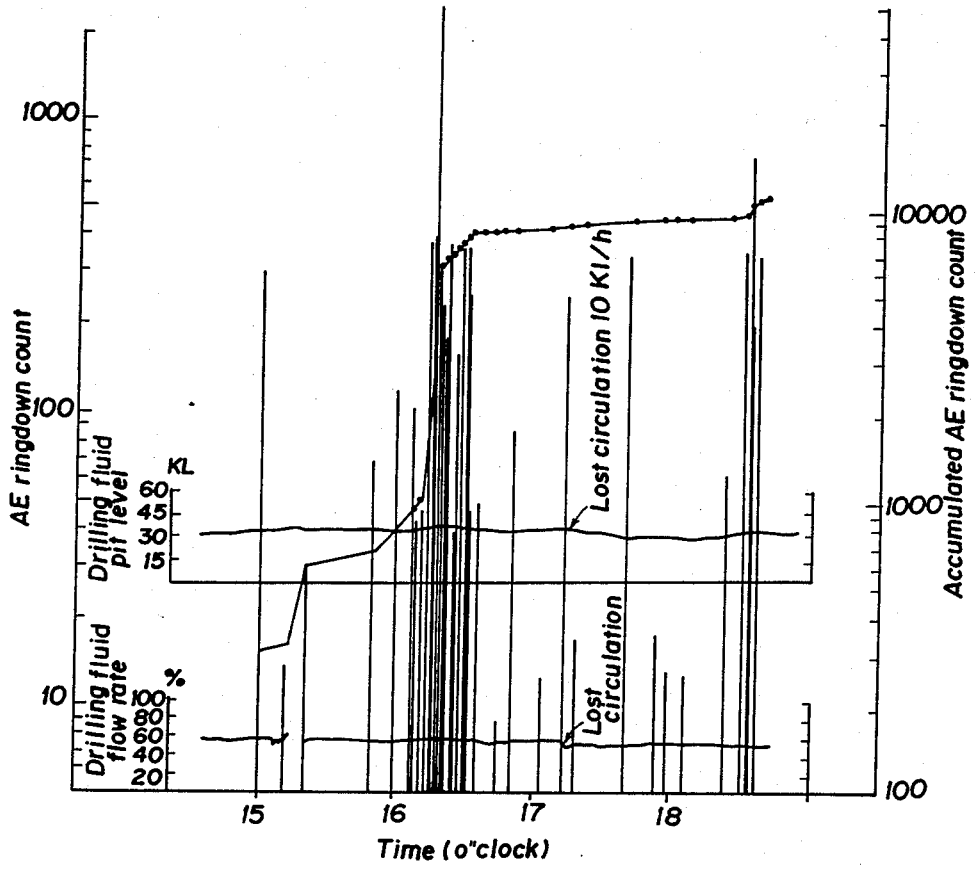
FIG. 2 is a graphical diagram showing the relationship between the time of partial lost circulation during drilling a well and AE ringdown count.
Figure 3:
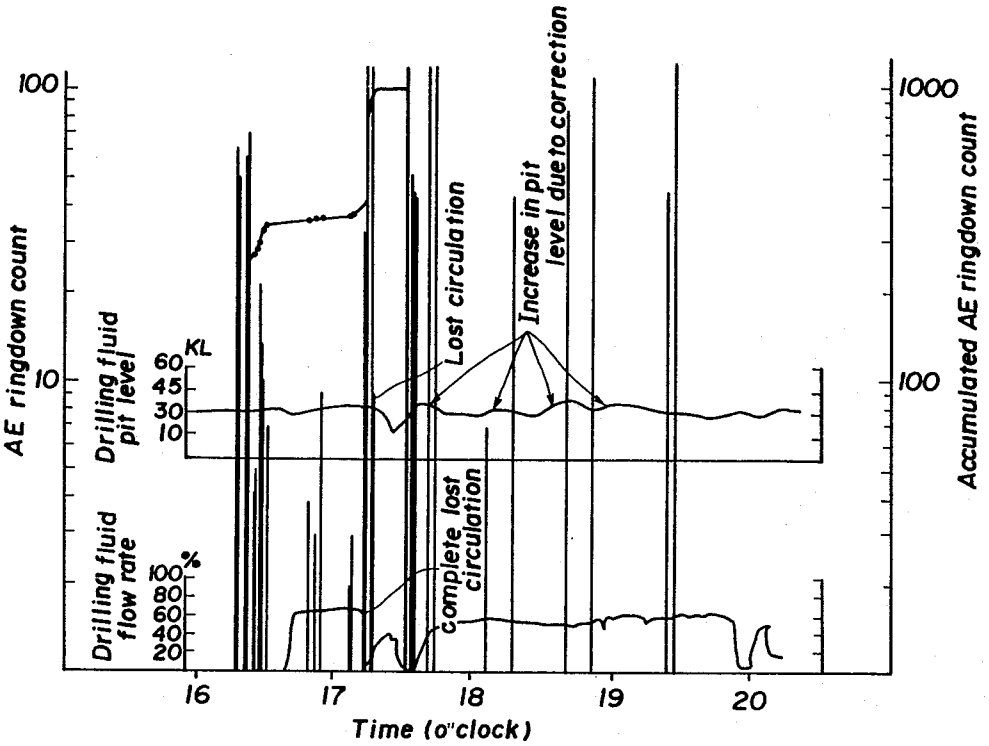
FIG. 3 is a graphical diagram showing the relationship between the time of complete lost circulation during drilling a well and AE ringdown count.
Figure 4:
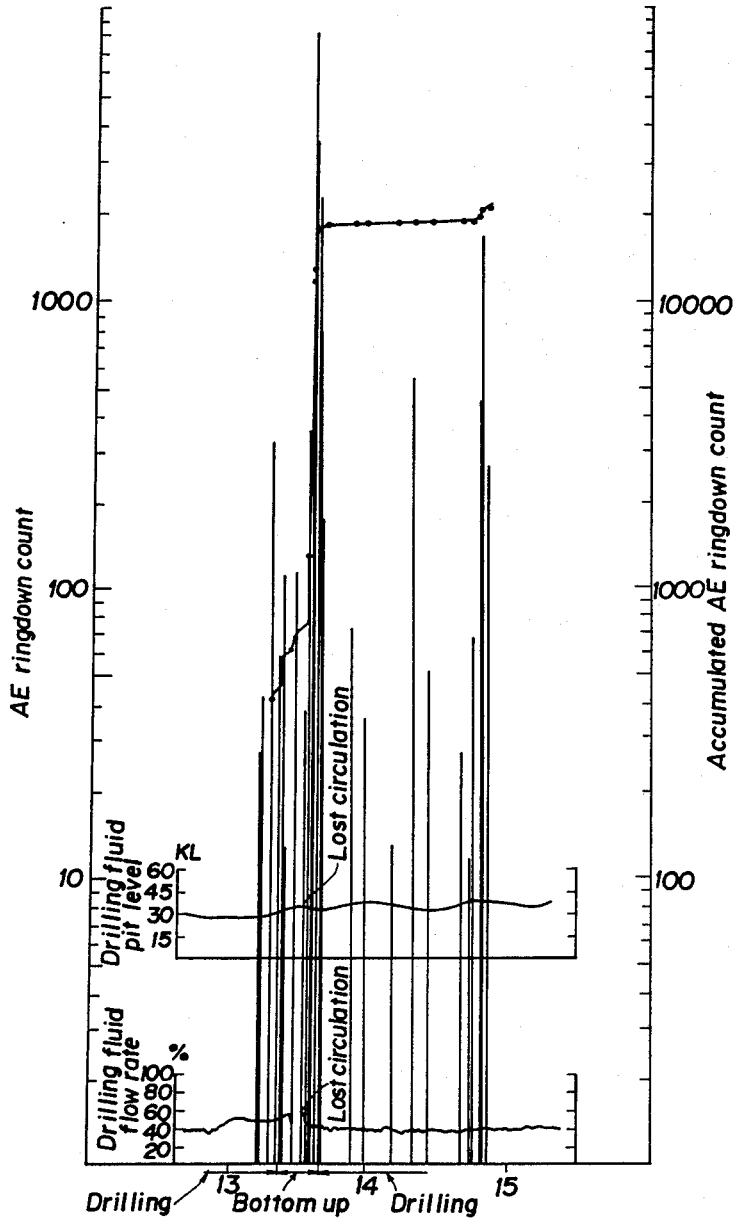
FIG. 4 is a graphical diagram showing the relationship between a time of encountering a lost circulation layer during drilling a well and AE ringdown count.

A well was drilled, a casing of 1000 m (vertical depth: 976 m) was set in a drilled borehole, an observation well (having 30 to 50 m of depth) was drilled, and an AE sonde was installed near the bottom of the observation well. Then, AE waves emitted at the periphery of the well were observed during the drilling job to obtain the result shown in FIG. 2. In FIG. 2, a bar graph designates AE ringdown counts at one minute intervals, and a folded curve for connecting the bar graph represents the accumulated value of the AE ringdown count (FIGS. 3 and 4 show similarly).

A lost circulation was identified by the variation in a stored drilling fluid by a drilling fluid pit level meter, and the variation in the drilling fluid flow rate was detected by a flow sensor.

As apparent from FIG. 2, a partial lost circulation at approx. 10 kilo-liters/hr occurred during drilling at 17 o'clock and 13 minutes (at 1306 m, 70 cm of drilling depth of the well).

The AE was activated from 16 o'clock and 10 minutes to around 16 o'clock and 30 minutes prior to the lost circulation, and the occurrence of a crack to cause the lost circulation was recognized at this time. The accumulated value (folding line in FIG. 2) of the AE after the lost circulation was gradually increased.

Therefore, in this case, hydrostatic pressure of drilling fluid was alleviated, or fluid pumping pressure of drilling fluid was regulated, or lost circulation prevention material was added at ground level, to prevent the lost circulation.

EXAMPLE 2

A well was drilled with an underground crack near 1300 m of depth as a target, a casing was then set (1000 m), the AE was observed in an observation well in which an AE sonde was installed similarly to Experimental Example 1, and the result shown in FIG. 3 was obtained.

As apparent from FIG. 3, the complete lost circulation with drilling break where a bit weight was dropped from 10 tons to 3 to 5 tons occurred at 17 o'clock and 13 minutes (1330 m, 30 cm to 1330 m, 80 cm of drilling depth of the well).

The AE was activated from around 16 o'clock and 20 minutes prior to the lost circulation, and the AE was abruptly increased when the complete lost circulation occurred (folding line in FIG. 3). Then, the AE was emitted dispersively upon decrease of the pit level storage drilling fluid. In FIG. 3, the storage amount detected by the pit level meter in FIG. 3 was increased after the lost circulation. The storage amount increased due to the supply of drilling fluid.

More specifically, when the crack propagating state under the ground from the AE in FIG. 3 emitting state was presumed, a main crack for causing a lost circulation was presented at 1330 m, 30 cm to 1330 m, 80 cm, and a readily collapsible microcrack zone existed at the periphery. When drilling at this state, damage starts to emit AE due to the hydrostatic pressure of drilling fluid. When arriving at the weakest portion of the ground layer, it was considered that the drilling fluid started moving through the main crack, and the crack was simultaneously developed by the hydraulic pressure of drilling fluid so that AE energy was abruptly increased.

Therefore, in this case, the hydrostatic pressure of drilling fluid is alleviated, the drilling fluid filling pumping pressure is regulated, or lost circulation prevention material is added at ground level, to prevent the lost circulation.

EXAMPLE 3

The emission of AE and the state of a lost circulation are shown in FIG. 4 in the case that a well was drilled with an underground crack near 1300 m of depth as a target. In this case, a bottom up occurred at around 13 o'clock and 20 minutes, and drilling was continued. Then, the complete lost circulation occurred at around 13 o'clock and 30 minutes.

The AE started activating from around 13 o'clock and 10 minutes prior to the lost circulation, the bottom up was further activated, and it was recognized that the AE was abruptly increased simultaneously at the lost circulation (folding line in FIG. 4). In this case, it was confirmed that the lost circulation coincided with the underground crack by geological survey or geophysical prospecting.

Figure 5:
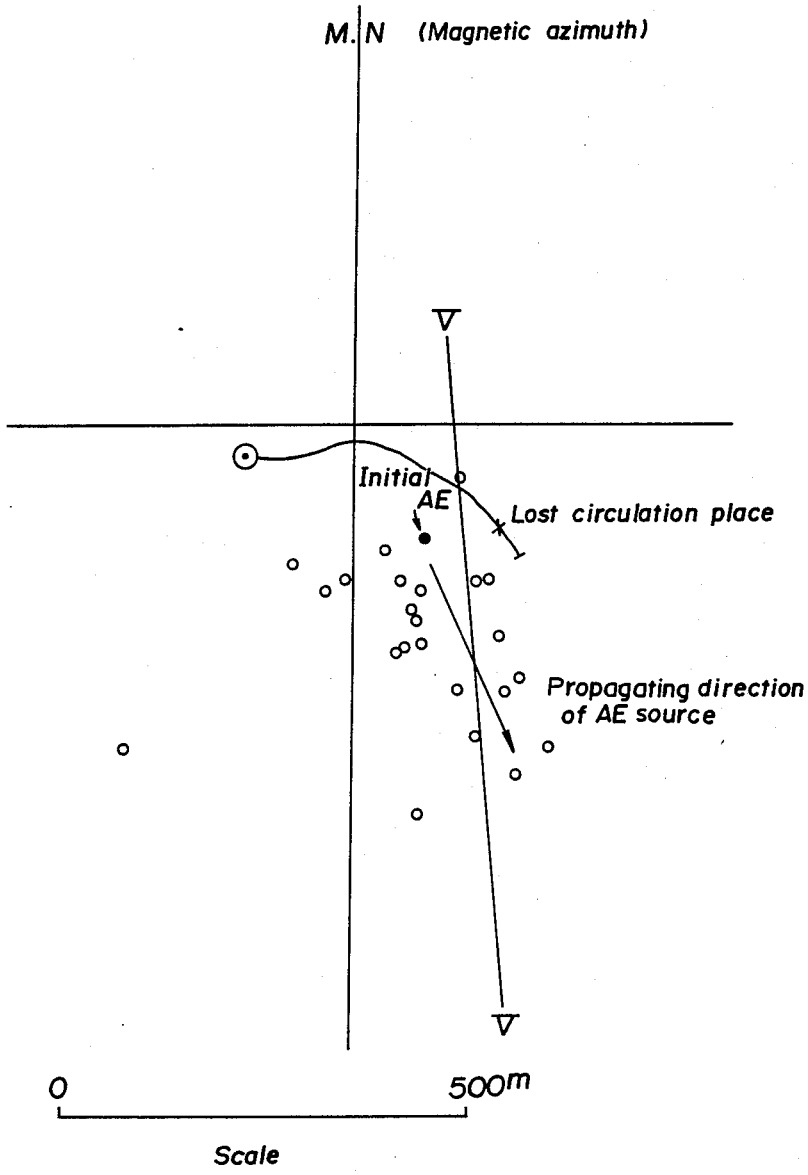
FIG. 5 is a plan distribution diagram of AE sources located by the tri-axial hodogram method.
Figure 6:
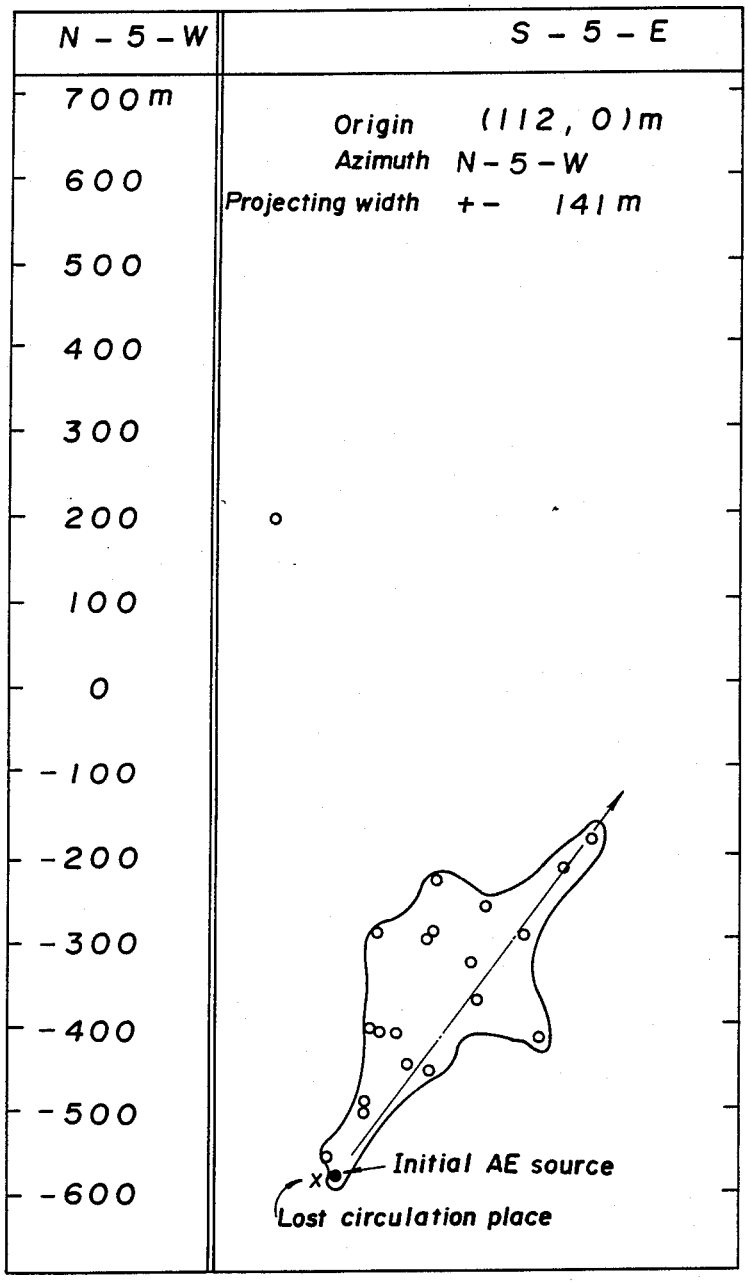
FIG. 6 is a vertical distribution diagram of AE source taken along the line V—V in FIG. 4.

FIGS. 5 and 6 show the distribution of the position of the AE source by hodogram method in the case that the underground crack was encountered to cause a lost circulation. As apparent from FIGS. 5 and 6, it was recognized that the encountered underground crack (lost circulation layer) was propogated at approx. 500 m for one minute in southern and eastern directions from 580 m above sea level to 180 m, and it was judged that sufficient scale existed as a geothermal reservoir.

Further, the production zone at the periphery was 200 m or deeper above sea level, the lower limit of the reinjection zone for reinjecting hot water was deeper than 0 m above sea level, and it was recognized that the underground crack was not directly connected with the reinjected hot water.

What is claimed is:

1. A method of utilizing acoustic emission(AE)-microseismic activity (MA) measurement to predict and prevent lost circulation during drilling of a well, said method comprising the steps of:
   - installing an AE sonde in an observation well,
   - monitoring an AE wave emitted at the periphery of the well by the AE sonde, and
   - drilling the well without lost circulation by providing lost circulation preventing means in a drilling fluid circulation system if the energy of the AE wave emitted at the periphery of the well increases.

2. A method according to claim 1, wherein said step of providing lost circulation preventing means comprises at least one of the step of reducing a pressure applied to the well and the step of adding lost circulation prevention materials in the drilling fluid.

3. The method according to claim 2, wherein the reduction of pressure applied to the well decreases the pumping pressure of the drilling fluid.

4. The method according to claim 2, wherein the reduction of pressure applied to the well decreases the specific weight of the drilling fluid.

5. A method of utilizing acoustic emission(AE)-microseismic activity(MA) measurement to monitor lost circulation during drilling of a well, said method comprising the steps of:
   - installing an AE sonde in an observation well,
   - monitoring by the AE sonde an AE wave emitted at the periphery of a lost circulation layer position if lost circulation occurs during drilling of the well to obtain information of the size of the lost circulation layer, and
   - drilling the well while determining whether drilling of the well should be continued or stopped in accordance with the information.

* * * * *